US005145473A

United States Patent [19]

Henry

[11] Patent Number: 5,145,473

[45] Date of Patent: Sep. 8, 1992

[54] POLYURETHANE FOAM EXERCISE DEVICE FOR UPPER BODY DEVELOPMENT

[76] Inventor: James R. Henry, 10964 W. 69th Ave., Arvada, Colo. 80004

[21] Appl. No.: 785,411

[22] Filed: Oct. 30, 1991

Related U.S. Application Data

[63] Continuation of Ser. No. 497,880, Mar. 23, 1990, abandoned.

[51] Int. Cl.[5] ..... A63B 5/00; A63B 37/00

[52] U.S. Cl. ..... 482/49; 273/58 B; 273/58 G; 482/44

[58] Field of Search ..... 272/67; 273/58 B, 58 E, 273/58 G, 128 R

[56] References Cited

U.S. PATENT DOCUMENTS

| | | | |
|---|---|---|---|
| 1,628,717 | 5/1927 | Flowers | 273/58 E |
| 3,497,216 | 2/1970 | Feather | 272/83 |
| 4,108,429 | 8/1978 | Minichello | 272/136 |
| 4,577,865 | 3/1986 | Shishido | 273/58 G |
| 4,598,909 | 7/1986 | Ventura et al. | 273/60 B |
| 4,610,071 | 9/1986 | Miller | 29/458 |
| 4,629,186 | 12/1986 | Aldridge | 272/135 |
| 4,702,474 | 10/1987 | Guibert | 272/122 |
| 4,718,666 | 1/1988 | O'Donnell et al. | 272/137 |
| 4,720,096 | 1/1988 | Rogers | 272/117 |
| 4,874,165 | 10/1989 | Steinberg et al. | 273/58 E X |

*Primary Examiner*—Gene Mancene
*Assistant Examiner*—L. Thomas

[57] ABSTRACT

A novel, hand-held, sphere-shaped, palm-compressible, upper-body exerciser is provided with a mechanical switch, placed within a cavity internal to the sphere.

5 Claims, 2 Drawing Sheets

POLYURETHANE FOAM EXERCISE DEVICE FOR UPPER BODY DEVELOPMENT

This application is a contination of Ser. No. 07/497,880, filed Mar. 23, 1990 and now abandoned.

BACKGROUND OF THE INVENTION

This invention relates to exercising devices. In particular it relates to a portable hand-operated ball used to develop muscles and to relieve stress in the hands, wrist, arms, shoulders, chest and back. Many types of exercise devices have been developed in recent times in response to the benefits and value derived from a regular exercise program. Many of these devices are used to develop the upper body, in particular the hands, wrist, arms, shoulders, chest and back are large, complex, cumbersome, unwieldy, expensive and sometimes dangerous to use if not operated properly. Therefore, a lot of development has centered around the production of uncomplicated, economical exercise devices that are effective and easily transported and can be used in the home or office environment.

BACKGROUND ART

Many of the exercisers constructed for upper-body development and stress release utilize powerful spring-type materials with handgrips that must be tightly grasped during the exercise routine and during activation to prevent it from slipping or dislodging from the hands. This construction is that as is found in the references of Feather: (U.S. Pat. No. 3,497,216); Aldridge, (U.S. Pat. No. 4,629,186); O'Donnell et al, (U.S. Pat. No. 4,718,666); Guibert, (U.S. Pat. No. 4,702,474); and that of Rogers, (U.S. Pat. No. 4,702,096); and Minichiello, (U.S. Pat. No. 4,108,429), and J. B. Flowers (U.S. Pat. No. 1,628,717). When inadvertent spring breakage, or slippage of the exerciser from the hands occurs as is commonly experienced with these prior exercisers, extensive injuries to the chest, bust, hands, arms, and head may occur. Additionally, the exerciser disclosed in the art of Feather (U.S. Pat. No. 3,497,216) is operated as a clamshell type device used in close proximity to the chest. As such, slight inattention during use may result in a pinching of the skin that is not easily forgotten.

Soft, foam-filled baseballs have always been sports enthusiasts favorites, as the "softball" produces less injuries when it is improperly handled. The identified art references of Miller (U.S. Pat. No. 4,610,071) and that of Ventura et al (U.S. Pat. No. 4,598,909) disclose construction methods of forming such "softballs", and are noted in the present invention only as a preferable method of construction "layering" and of molding the present exerciser.

It therefore becomes imperative to provide a portable exercise device that has no danger of becoming a flying missile that can bring harm to individuals or property during it's use. A hand held exerciser is required that is small, lightweight, stable in operation and can be used by children as well as adults in a safe, unobtrusive and effective manner.

SUMMARY OF THE INVENTION

The present invention is an exercise device that meets the aforementioned attributes by providing a new and novel approach to relieving stress and developing muscles in the hands, wrists, arms, shoulders, chest, bust, stomach and back, utilizing varying hand and arm positions during its operation. The present invention provides a soft, polyurethane foam plastic sphere, having a semi-smooth, grip-type external skin providing a protective cover with added gripping properties and a semi-rigid internal skin providing an oval shaped cavity, with opposing hard surfaces for the attachment and co-activation of an internal mechanical switch manufactured by General Electric Co. under part number 537011D5. Exercises are performed by interlocking the fingers of both hands, and grasping the surface of the exercise device with the palms of the hands centered directly over the marked "activation index points". The sphere may then be hand-compressed between the palms of the interlocked hands, and squeezed until a sound and/or vibration is emitted from the mechanical switch located in the internal cavity; the sound and/or vibration resulting from the full "compression" of the switch.

OBJECTS OF THE INVENTION

An object of the present invention is to provide a new and novel device for relieving stress and providing muscle development of the hands, wrist, arms, shoulders, chest, bust, stomach and back.

Another object of the invention is to provide and exerciser that is small, lightweight, inexpensive, portable and easy to use by women, men and children.

It is another object of the invention to provide a sphere that is deformable, and will quickly resume the original spherical shape after having been distorted by the operator, after compressing the spherical exerciser.

Still another object of the invention is to provide an exerciser that will easily conform to the natural gripping or cupped position of the hands, so as to enable an operator to securely grasp the device without the exerciser slipping from the hands during its use.

Another object of the invention is to provide a hand-held exerciser that will emit a sound and/or vibration from the switch only when the device is fully hand compressed.

Yet another object of the invention is to provide an exerciser that is soft and therefore provides a high degree of safety. The softness and the safety factor embodied in the device encourages its widespread and continual use.

A further object of the invention is to provide an exerciser which is unobtrusive to exercise with and to utilize.

It is a further object of the present invention to provide a reliable spring-type switch, enclosed internally to the spherical hand-held exerciser.

ADVANTAGES OF THE PRESENT INVENTION

It has been proven in many studies that only a small amount of resisted movement of the muscles when they are in the flexed condition can give the greatest amount of development to the muscle. This type of exercise is commonly known as isometric exercise. This present invention utilizes this principal of small resisted movement of the muscles in the flexed condition to achieve the desired results of muscle growth and stress release.

One of the advantages of this invention is that even if the device is not used properly and it slips out of the hands, it will not in itself cause injury to the participant or onlookers due to its light weight and soft external characteristics.

A further advantage of the present invention is to provide an internal switch "resistance element" to enhance the physical exercise motion when the present invention is used in the hands.

Another important advantage of the present invention is that there are no sharp pinching or cutting edges or powerful external springs utilized as is the case of most prior art, that can unexpectedly and suddenly break, causing personal injury and/or property damage.

DETAILED DESCRIPTION OF THE PREFERRED EMBODIMENT

Figure 1:
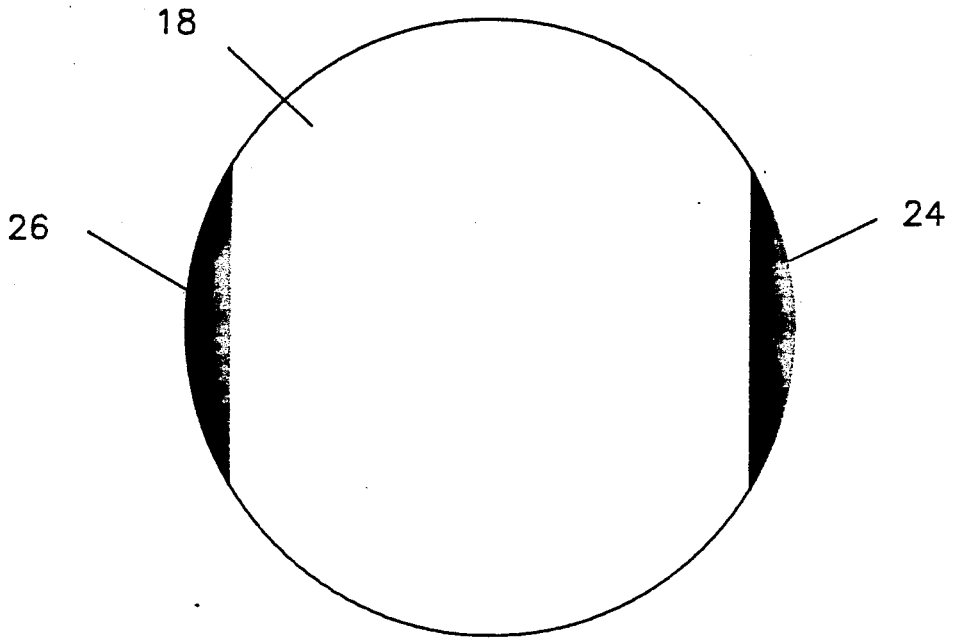
FIG. 1 is a perspective view of a preferred embodiment of the invention showing the compression index points used to properly locate the left and right hands in proper gripping fashion for the exercise.
Figure 2:
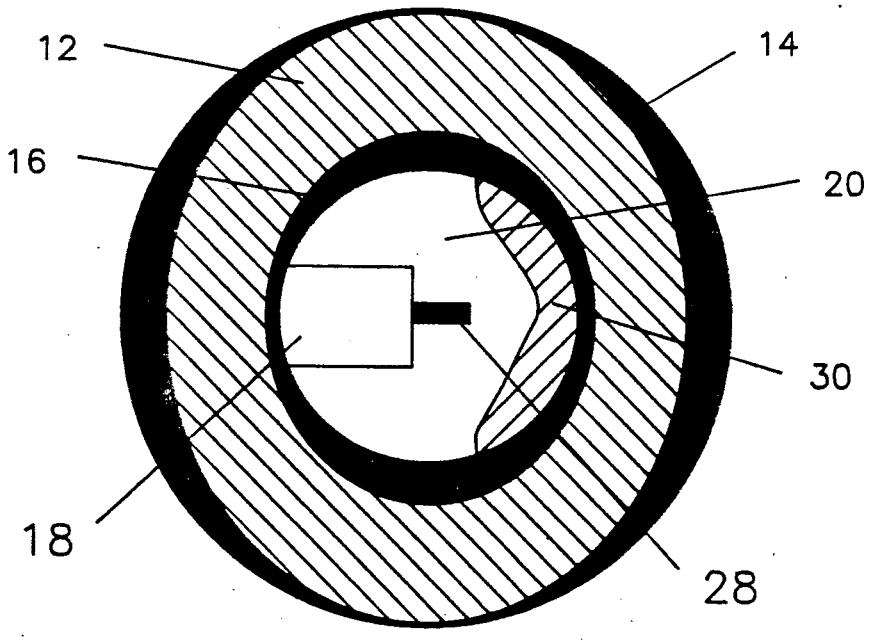
FIG. 2 is a sectional view of FIG. 1 so as to show the switch deployed internal of the present invention along with the switch receptacle deployed opposite the switch.
Figure 3:
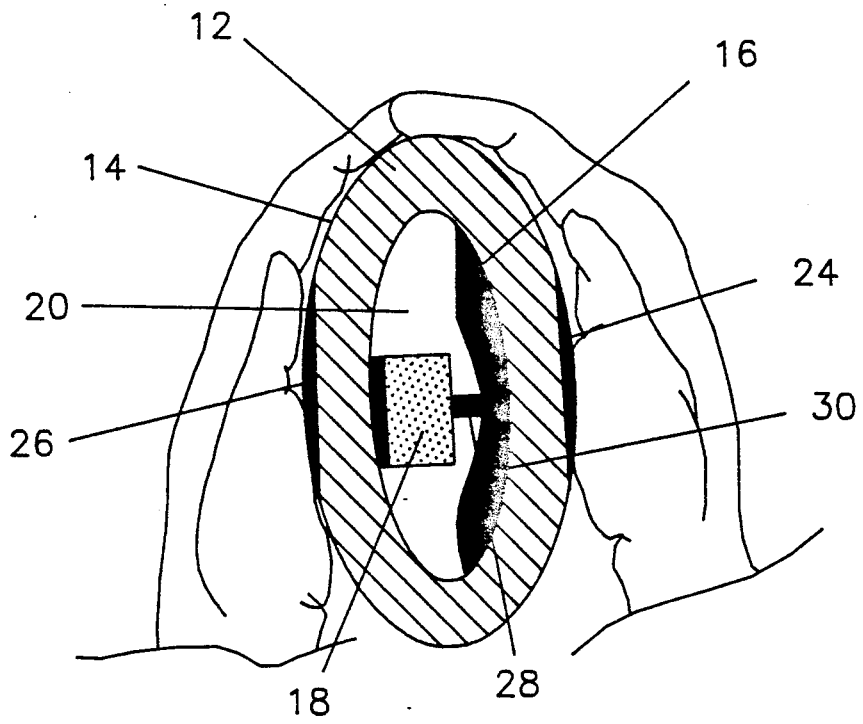
FIG. 3 is a sectional view of the exerciser during full compression with hands closed.
Figure 4:
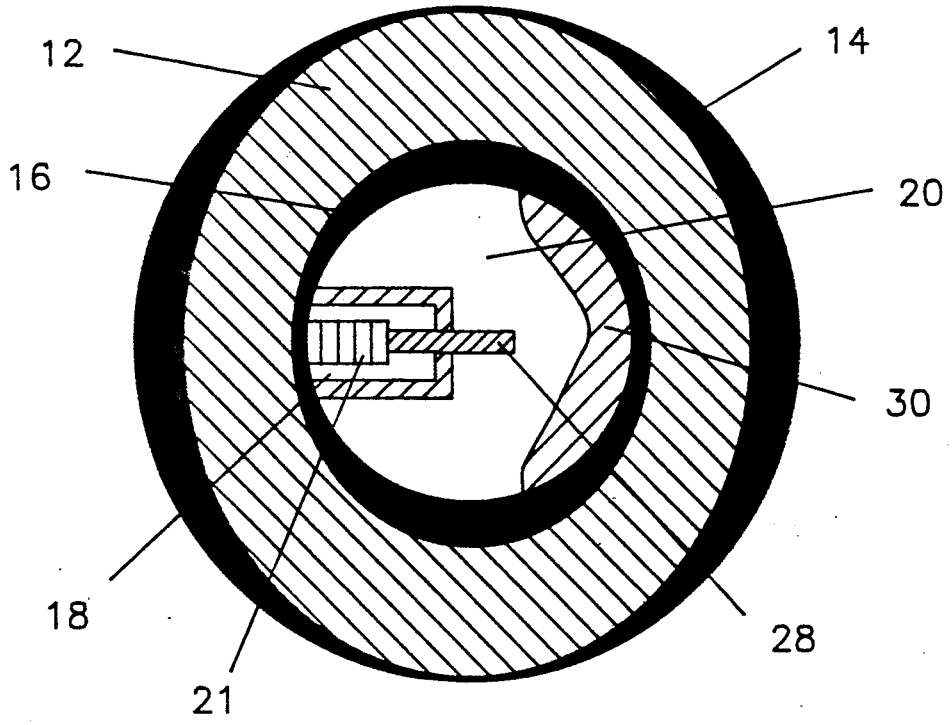
FIG. 4 is a sectional view of the present invention, illustrating a cut-away view of the General Electric Switch part number 537011D5 deployed internal of the present invention.

The preferred embodiment of the exercise device exemplifying the invention has been identified generally by the reference #10. The preferred method of forming the layers hereinafter identified is injection molding. The invention may vary slightly in size and material composition to accommodate for differing hand sizes and strength variances in individuals. The preferable outside diameter of the device is within the range of 3.00 to 3.75 inches. The sphere is comprised of an intermediate layer 12 of foamed polyurethane plastic, having a density of approximately 15 pounds per cubic foot. The outer surface layer 14 consists of polyurethane foamed and molded plastic which has a density of approximately 20–25 pounds per cubic foot providing a preferably round, semi-rigid cavity 20, in which a switch, General Electric part number 537011D5 18 is attached to the inner skin 16 and internal to the cavity 20 with an adhesive bonding material. On the opposite side of the switch is a switch receptacle 30 used to stabilize the switch during compression of the exercise device. The receptacle 30 is also attached to the inner skin and internal to the cavity 20 with a adhesive bonding material. The thickness of the outer layer 14 is preferably a minimum of 0.02 inches, which forms the outer layer 14 and provides a 25 protective cover. The inner skin 16 forms a central, cavity 20 which is a minimum of 0.03 inches in thickness. The general thickness of the intermediate layer 12 is preferably approximately 1.0 inches. The thickness of the switch receptacle 30 is preferably in the range of 0.25 to 0.35 inches made of an elastomeric material which is relatively dense and resilient.

One of the features of the exercise device 10 resides in the fact that the sphere 10 is relatively soft when compared to other exercise devices identified in the specification. The relatively soft foam intermediate layer 12 provides a higher degree of safety than these other devices preventing injuries to participants and others nearby. The outer layer 14, which functions as a protective cover, is not completely smooth but has a semi-smooth, slightly pumiced, grippable surface which is conducive to keeping the sphere 10 from slipping from the hands during the compression phase of the exercise. While the outer surface layer 14 is not completely impervious to the entrance of moisture coming from perspiration on the hands, or washing the surface, optional painting of the outer surface skin 14, with a barrier coat of polyurethane or latex paint serves to coat the outer surface layer 14 of the exercise device 10, and to provide an aesthetic appearance. Over a period of time and extended use, the paint may wear off to some degree due to the flexing of the outer surface layer 14.

The outer surface layer 14, and the injection molded foamed intermediate layer 12 should possess a hardness having a value within the broad range of 15–30 pounds per cubic foot, the lower end of the range preferable for an individual with a lesser degree of hand strength and the higher end of the range preferable for an individual with a greater degree of strength. To this end, the internal switch 18 may also be fitted with differing spring tensions and the switch receptacle 30 be made thinner or thicker. The switch receptacle 30 having a general durometer value between 40 and 55 (more specifically, from 40–50 shore.) The outer layer 14 of the sphere 10 conforms to the natural gripping or cupping action of the device 10 when the fingers are interlocked 5 over the surface of the device. The compression index points 24, for the right hand and 26, for the left hand are depicted in FIG. 1 The purpose of said compression index points 24 and 26 are to enable the operator to locate the center of palms of the hands on these points with an 10 interlocking of the fingers in order to properly perform the exercise, while activating the switch 18.

In the preferred embodiment of the invention, the switch 18 is activated by the compressing action of the hands over the compression index points 24 and 26, (which are comprised of painted circles, approximately 0.025–0.50 inches in diameter,) which then causes the inner skin 16 to compress against the switch push rod 28 to travel approximately 0.25 inches, and to compress the spring 21 to the "flex limit," into and against the receptacle 30 thereby activating a sound and/or vibration from the switch 18, audibly indicating a successful compression cycle of the exercise device 10. The aforementioned preferred embodiment is given by way of example only, and not by way of limitation to the invention, which is solely described by the claims herein following. Various modifications, changes, additions, an application other than those specifically outlined herein will become readily apparent to those and scope to the present invention, and may be considered to be within the scope and essence of my invention. For example, layers could be made from other elastomeric materials having the same or similar properties and other similar "switches" could be substituted. For example, natural or synthetic rubber could substituted or varied according to desire and ease of construction be determined not entirely by the foregoing specification, and the embodiments illustrated in the drawings, but rather be determined by the appended claims and their legal equivalents.

I claim:

1. A muscle exerciser comprising:

a ball having an outside surface and an inner hollow cavity:

a spring operated switch having a single push rod wherein said spring operated switch is positioned within said cavity, said push rod extending into said cavity;

a switch receptacle positioned within said cavity, whereby when said ball is compressed, the push rod contacts said receptacle.

2. The muscle exerciser set forth in claim 1, further comprising index points located on said outside surface.

3. The muscle exerciser set forth in claim 1, wherein said ball is comprised of three layers.

4. The muscle exerciser set forth in claim 1, wherein a sound is produced when the push rod contacts said receptacle.

5. The muscle exerciser set forth in claim 1, wherein a vibration is produced when the push rod contacts said receptacle.

* * * * *